US007513376B2

(12) United States Patent
Sprave

(10) Patent No.: US 7,513,376 B2
(45) Date of Patent: Apr. 7, 2009

(54) SEPARABLE CENTER POSITION COUPLING

(75) Inventor: Rainer Sprave, Goslar (DE)

(73) Assignee: Voith Turbo Scharfenberg GmbH & Co. KG, Salzgitter-Watenstedt (DE)

( * ) Notice: Subject to any disclaimer, the term of this patent is extended or adjusted under 35 U.S.C. 154(b) by 272 days.

(21) Appl. No.: 11/417,152

(22) Filed: May 4, 2006

(65) Prior Publication Data

US 2006/0249470 A1 Nov. 9, 2006

(30) Foreign Application Priority Data

May 6, 2005 (EP) ..... 05009976

(51) Int. Cl.
*B61G 5/00* (2006.01)
*B61G 9/00* (2006.01)

(52) U.S. Cl. ..... 213/75 R; 213/18; 213/19; 213/20

(58) Field of Classification Search ..... 213/15, 213/19, 20, 75 R, 18, 21
See application file for complete search history.

(56) References Cited

U.S. PATENT DOCUMENTS

| | | | | | |
|---|---|---|---|---|---|
| 2,802,580 | A * | 8/1957 | Larson | 213/45 |
| 3,624,781 | A * | 11/1971 | Randolph et al. | 213/20 |
| 3,907,122 | A * | 9/1975 | Ksienysk et al. | 213/14 |
| 4,013,175 | A * | 3/1977 | Klein et al. | 213/20 |
| 4,289,247 | A * | 9/1981 | Brand et al. | 213/20 |
| 4,500,300 | A * | 2/1985 | Wolf et al. | 464/83 |
| 5,472,104 | A * | 12/1995 | Domsgen | 213/4 |
| 6,805,251 | B2 * | 10/2004 | Radewagen et al. | 213/20 |
| 7,055,705 | B2 * | 6/2006 | Sprave | 213/20 |
| 2003/0116519 | A1 * | 6/2003 | Radewagen et al. | 213/20 |
| 2005/0121404 | A1 * | 6/2005 | Sprave | 213/75 R |
| 2005/0145591 | A1 * | 7/2005 | Mattschull et al. | 213/75 R |
| 2006/0249470 | A1 * | 11/2006 | Sprave | 213/75 R |

FOREIGN PATENT DOCUMENTS

| | | | |
|---|---|---|---|
| DE | 103 55 640 | B3 | 11/2004 |
| DE | 10355640 | B3 * | 11/2004 |
| EP | 1 127 769 | A | 8/2001 |

* cited by examiner

*Primary Examiner*—S. Joseph Morano
*Assistant Examiner*—Jason C Smith
(74) *Attorney, Agent, or Firm*—Jean C. Edwards, Esq.; Akerman Senterfitt

(57) ABSTRACT

The present invention relates to a central buffer coupling for rail-mounted vehicles having a coupling shaft arranged to be vertically pivotable around an articulated housing of a railway vehicle and supporting a coupling head and a device for horizontal resetting to center at its free end. In order to realize a disengaging of the frictionally-locked connection between an actuating means of a center position device and a coupling shaft in the event of a crash; i.e., upon extreme impact/tractive force being transferred through the coupling shaft, a separable center position coupling in accordance with the invention is provided, which disengages the frictionally-locked connection between the actuating means and the center position guide upon a definable critical impact/tractive force being exceeded.

10 Claims, 3 Drawing Sheets

SEPARABLE CENTER POSITION COUPLING

CROSS-REFERENCE TO RELATED APPLICATIONS

The present application claims priority from European Patent Application No. 05 009 976.1, filed May 6, 2005, the contents of which are herein incorporated by reference in their entirety.

BACKGROUND OF THE INVENTION

1. Field of the Invention

The present invention relates to a central buffer coupling for rail-mounted vehicles having a coupling shaft arranged to be vertically pivotable around a linkage of the railway vehicle body and supporting a coupling head and a device for horizontal resetting to center at its free end, wherein the device for horizontal resetting to center has a center position guide following a horizontal pivoting movement of the coupling shaft around a vertical pivot axis, as well as actuating means for positioning the center position guide together with the functionally-connected coupling shaft at predefined positions or into any position of a given range of pivoting.

2. Description of the Related Art

Such coupling arrangements are essentially known from the prior art and are characterized by enabling the smoothest possible coupling between two central buffer couplings. The device for resetting to center is hereby usually configured such that a resetting to center follows from deflections of the coupling shaft in the horizontal plane and thus the coupling shaft can always be kept in the center position in the center longitudinal plane during the coupling procedure. A great number of resetting systems are known for realizing such a device for resetting to center which affords the setting of the center position in the horizontal plane e.g. hydraulically or by spring action.

To illustrate the principle of resetting to center, FIG. 1 shows a partially cut-away side view of a device 3 for resetting to center as known from the prior art and disclosed for example in EP 1 321 344 A1. This device 3 for resetting to center, pivotably affixed by means of a coupling shaft 2 to a railway vehicle central buffer coupling, exhibits a center position guide 4 following the pivoting movement of the coupling shaft 2 around its vertical pivot axis which is tensionally-locked to actuating means 5 by means of a gearing.

Specifically, the center position guide 4 in the coupling arrangement according to FIG. 1 is configured as a cam plate pivotally supported at the linkage 1 of the coupling arrangement by means of a vertically attached swivel pin 14. Cam plate 4 is coupled to coupling shaft 2 in a synchronously rotating manner and swivel pin 14 is arranged axially aligned to a bearing bolt 15 of coupling shaft 2. Swivel pin 14 itself is functionally connected to bearing bolt 15 while cam plate 4 is fixedly connected to a gear 16 arranged below said cam plate 4 which itself is connected with and can be driven by an actuating means of the device 5 for resetting to center by a gearing 17 serving as an adjusting drive.

Arranging multi-stage buffer systems on the underframe of railway vehicles is furthermore known from rail-mounted vehicle technology. These devices usually have a reversible buffer system as the primary stage, integrated in the form of, for example, a coupling spring in the coupling shaft and which absorb forces of shock occurring during travel, switching and coupling operations. It is also possible to provide drawgear/shock mechanisms at the bearing for the linkage with which the coupling shaft is attached to the underframe of the vehicle body. The drawgear/shock mechanisms provided in the linkage absorb tractive/compressive forces up to a defined magnitude and transfer the forces undamped therefrom to the vehicle underframe via the bearing.

While drawgear/shock mechanisms do absorb the tractive/impactive forces which occur between the individual vehicle bodies during normal travel, when exceeding operational load, however, for instance in the case when the vehicle impacts an obstacle, it is possible that the coupling's given absorption of energy will not be sufficient. The excess impact energy is then transferred directly to the vehicle underframe. In the process, same is subject to extreme loads such that the vehicle body runs the risk of being damaged or derailed.

One approach to preventing such a situation provides for, in addition to drawgear/shock mechanisms, a further (secondary) buffer system, for example in the form of two side buffers at the outer edge of the front of the respective vehicle body to absorb the impact energy resulting from excessive slack impacts. It is also possible, after the primary buffer system has been fully tapped, to divert residual energy through a predetermined break point in the coupling linkage to buffer elements on the vehicle body, for example friction elements.

This so-called overload protection serves as additional protection against damage resulting from shocks to the vehicle underframe upon strong rear-end collisions. To reduce the impact energy, the coupling with the linkage as well as the center position device is first pushed to the rear out of the coupling plane and thus removed from the force flux transferred between two neighboring vehicle bodies. For example, it is conceivable that after exceeding a critical impact force, the linkage of the coupling arrangement shears off at predetermined break points and larger components of the coupling are moved into an area of the vehicle body's underframe by a crossbar disposed at the front of the vehicle body.

However, with coupling arrangements affixed to the vehicle body by means of a linkage having a center position device, such an overload protection presupposes the corresponding configuration to the connecting plate (crossbar) at which the coupling arrangement linkage is tensionally-locked to the vehicle body, the underframe of the vehicle body respectively, and by means of which in the event of a crash; i.e., upon extreme impact force, the linkage with the center position device and the coupling shaft are pushed through after the response of the shearing elements. The term "shearing elements" here refers to connective elements which in "normal" traveling operation connect the linkage and thus, the coupling arrangement to the connecting plate or the vehicle body, and which lose their function as connective elements after a definable critical impact/tractive force has been exceeded, so that the linkage with the center position device and the coupling shaft as need be, will be pushed into an area provided for this purpose at the underframe of the vehicle body by the connecting plate of the vehicle body.

The disadvantage to this known prior art solution can be seen in that the crossbar disposed at the front of the vehicle body and serving as the connective member needs to be of relatively wide and tall configuration, since in the event of a crash and after the shearing elements response, not only the linkage but also the entire center position device needs to be moved backward and pushed by the crossbar, thus meaning a relatively large effective contact area is needed for the crossbar. In configuring the crossbar, the corresponding connective members respectively, for such a coupling arrangement, it is therefore necessary to design the crossbar accordingly, which results in increased weight to the connective members and especially the coupling arrangement as a whole.

SUMMARY OF THE INVENTION

The present invention is related to providing a coupling arrangement attached by a linkage to the front of a vehicle body and having a center position device which is removable from the energy flux through the coupling shaft upon the exceeding of a critical impact force, whereby the connective members, serving to connect the linkage with the front of the vehicle body, can be configured more simply and of smaller dimension.

The present invention includes a central buffer coupling of the type described at the outset in that the center position guide is tensionally-locked by means of a center position coupling for transferring a restoring moment of the actuating means to the center position guide, whereby the tensionally-locked connection disengages upon the exceeding of a definable critical impact/tractive force exerted longitudinal to the coupling shaft and transferred by same.

The present invention affords a number of essential advantages over central buffer couplings known in rail vehicle technology and as described above. In "normal" travel operation, the central buffer coupling serves to transmit the restoring moment of the actuating means to the center position device and to tensionally lock the actuating means and the center position guide. However, in the event of a crash; i.e., upon a definable critical impact/tractive force exerted longitudinally on the coupling shaft and transferred by same being exceeded, this tensionally-locked connection disengages by itself. This is thus, a separable center position coupling in which the transmission of torque and the tensionally-locked connection between the actuating means of the center position device and the remaining components of the coupling arrangement is broken upon occurrence of a pre-definable incident. The inventive solution is based on the fact that the actuating means of the center position device, which can, for example, be disposed with a pneumatically-operated lift cylinder and/or an electrically-driven means of actuation is arranged on the vehicle body below, above or to the side of the actual linkage of the central buffer coupling, and that the restoring moment of the actuating means will be transferred to the coupling shaft by a transfer mechanism, for example a gearing and/or a center position guide. The coupling shaft, which is pivotably linked to the front of the associated vehicle body by the linkage, can therefore be positioned in predefined positions or in those positions of an intended range of pivoting using the actuating means and the center position guide.

The solution according to invention, in which the separable center position coupling connects the actuating means of the center position device with the center position guide disposed in the linkage, in particular, realizes configuring the linkage encompassing the entire center position device as one single module and, as such, can thus, be attached to a connecting plate provided for the purpose on the front side of the vehicle body and/or to the vehicle body's underframe using the correspondingly provided connective members (e.g., a crossbar). This facilitates the assembly and disassembly of the coupling arrangement. This attaching of the linkage to the connection plate preferably ensues with shearing elements which lose their function as connective elements upon a definable critical impact force being exceeded and thus, allow the connecting plate to effect a backward motion on the linkage. As the linkage and the coupling shaft linked to it are thus taken out of the energy flux through the coupling shaft, secondary buffer systems disposed on the vehicle body, for example, can be used to absorb the excess impact energy.

Since according to the invention, the actuating means of the center position device is connected with the center position guide disposed in the linkage of the coupling arrangement by means of a separable center position coupling, and since not only the shearing elements provided in the overload protection but also the center position coupling responds and loses its function as a connective member upon the definable critical impact/tractive force being exceeded, exceeding of the critical impact/tractive force only leads to a backward motion of the linkage with the center position guide disposed thereon and tensionally-locked to the coupling shaft while there is no change to the actuating means of the center position device in front of the vehicle body's connecting plate. In consequence thereof, the connective members, as for example the crossbar at the front of the vehicle body on which the coupling arrangement linkage is attached, can be configured simpler and of smaller dimension since in the event of a crash, only the linkage without the actuating means is breached by the connecting plate in its backward motion and pushed into, for example, an area provided for the purpose in the underframe of the vehicle body. Specifically, the crossbar serving as the connective member can be configured e.g., flatter, which in particular results in reducing the weight of the overall coupling arrangement.

It is thus particularly preferable, for example, for the center position coupling to exhibit a respective outer transfer element on the center position guide and on the actuating means and at least one further middle transfer element arranged between these transfer elements, whereby each of the outer transfer elements engage with the middle transfer element in such a way so as to be able to transfer a restoring moment of the actuating means to the center position guide. The advantage of a separable center position coupling configured as such, is especially to be seen in its ensuring a reliable transmission of torque from the actuating means of the center position device to the center position guide in a particularly simple and easy-to-realize way, based on the engagement of the transfer elements. Because the transfer elements engage with one another, the separable center position coupling furthermore exhibits the function of a compensating coupling. It is thus configured, for example, to compensate for an offset between the actuating means of the center position device and the center position itself. Of course, other embodiments are just as conceivable here, for example having a plurality of middle transfer elements which are tensionally locked in engagement with one another.

A particularly advantageous realization of the latter embodiment in which the separable center position coupling thus has one outer transfer element disposed on the center position guide and one on the actuating means and at least one middle transfer element arranged between these outer transfer elements, provides for the center position coupling to be configured in such a manner that upon exceeding of the definable critical impact/tractive force, the engagement between at least one of the at least two outer transfer elements and the middle transfer element releases and thus the force-fit connection between the center position guide and the actuating means is disengaged. In consequence thereof, the linkage is pushed backward by the crossbar configured as a connecting plate; i.e., out of the coupling plane, and thus taken out of the force flux.

So that upon a critical impact/tractive force being exceeded, the engagement of the transfer elements provided on the separable center position coupling in accordance with the two previously cited embodiments can be reliably released and, as a consequence thereof, the tensionally-locked connection between the center position guide and the actuating means can disconnect, an advantageous realization of the center position coupling provides for a pin extending lengthwise the vertical pivot axis of the center position guide and through the respective transfer members which is fixedly connected at one end to the center position guide and at its other end to the actuating means. This pin is configured in such a way that it shears off upon the definable critical impact/tractive force being exceeded and thus enables the disengaging of the respective transfer element engagements. It would be conceivable here for the pin to exhibit correspondingly configured break points. It is further conceivable for the pin to be connected to the center position guide and/or the actuating means by shearing elements, whereby these shearing elements lose their connective function upon the definable critical force being exceeded. Since the pin extends through the respective transfer elements and is rigidly connected at one end to the center position guide and at the other to the actuating means, the transfer members are on the one hand held in position and, on the other, a pivoting movement of the transfer elements about the vertical pivot axis is enabled in order to ensure the transfer of the restoring moment to the center position guide and thus to the coupling shaft. Of course, instead of a pin which loses its function as a connective element upon the exceeding of a definable critical impact/tractive force, it is also conceivable here to provide other mechanisms which exhibit similar functions.

In a particularly advantageous realization of the inventive central buffer coupling having the separable center position coupling in which a plurality of cooperative transfer elements are utilized, the outer transfer elements arranged on the center position guide and on the actuating means each exhibit at least one central crosspiece and that the at least one middle transfer member exhibits at least two grooves in correspondence to said central crosspieces, whereby said grooves provided in the middle transfer member are respectively configured so as to each receive a corresponding central crosspiece of the outer transfer elements so as to enable the transfer of the restoring moment of the actuating means to the center position guide.

As an alternative to the latter embodiment of the separable center position coupling, it is furthermore conceivable for the middle transfer element to exhibit at least two central crosspieces, and whereby the outer transfer elements respectively arranged on the center position guide and on the actuating means each exhibit at least one groove corresponding to at least one of the central crosspieces, wherein the at least one groove disposed in the respective outer transfer element is respectively configured such that it receives at least one corresponding central crosspiece of the middle transfer element in order to thus enable transmission of the restoring moment of the actuating means to the center position guide. Both alternative embodiments relate to an especially simple to realize but yet effective solution of ensuring a separable center position coupling. It is of course also conceivable for the corresponding transfer elements to also exhibit a plurality of grooves or crosspieces. Nor do the crosspieces need to be configured as central crosspieces.

In one possible realization of the transfer elements having the features as specified above, a feasible middle transfer element would be a cross-staff having grooves disposed at 90° on its respective opposite sides. The outer transfer elements respectively disposed on the center position guide and on the actuating means can likewise be configured as plates and respectively exhibit the corresponding crosspieces, e.g., central crosspieces, offset 90° from one another, so as to fit the grooves provided in the cross-staff. Of course, other configurations to the transfer elements are just as conceivable here.

In order for the middle transfer element to respectively be controlled by the outer transfer elements upon the critical impact/tractive force being exceeded, a particularly preferred embodiment provides for at least one of the respective central crosspieces of the corresponding outer transfer elements being pivotably supported about a transverse axis of the respective central crosspiece, and that at least one of the respective central crosspieces is fixed.

In order to allow the separation process of the center position coupling to take place upon a precisely foreseeable event, a particularly preferred embodiment of the inventive coupling arrangement provides for the center position coupling to further exhibit guide means which are configured so as to guide the grooves disposed in the corresponding transfer elements into the respectively corresponding crosspieces of the corresponding transfer elements in the respective longitudinal direction of the grooves and, at the same time, substantially suppress a relative movement between the respective grooves and the corresponding crosspieces in directions other than the longitudinal direction of the respective groove. This guide means thereby ensures that the separation process to the engagement of the middle transfer element with the outer transfer elements ensues in a predefined and controlled motion. Since the guide means prevents relative movement between the respective groove and the corresponding crosspiece in directions other than the longitudinal direction of the respective groove, nor can the outer transfer elements move relative the middle transfer element in any direction other than the longitudinal direction of the respective groove so that, on the one hand, a secure purchase of the transfer elements relative one another is advantageously attained in "normal" travel and, on the other, premature responding of the separable center position coupling is prevented.

It is thus conceivable, for example, for the guide means to exhibit a tongue-and-groove connection of the groove and the crosspieces of the respective transfer elements. It is also conceivable to select the profile of the groove disposed in at least one of the transfer elements and the profile of the corresponding crosspiece accordingly, so as to ensure a guide in the respective longitudinal direction of the grooves and, at the same time, substantially suppress a relative movement in a direction other than the longitudinal direction. As an example of such a profile would be a dove-tailed profile, wherein the broad side of the dove-tailed profile is at the base area of the groove, the respective face of the crosspiece respectively. Of course, other profiles are also just as conceivable here.

It is also conceivable to configure the guide means in such a way that in addition to the function as a guide for the transfer elements relative one another, it also takes on the function of a shearing element. This could be realized, for example, in that the guide function only disconnects after a definable critical release load has been exceeded. Should the guide means have a tongue-and-groove connection, it is, for example, conceivable to configure this tongue-and-groove connection in "perforated" fashion; i.e., the groove of the tongue-and-groove connection is disconnected by a shearing crosspiece at least at one position with this crosspiece being configured as a shearing element which disengages the groove of the tongue-and-groove connection disposed for guidance upon responding. Other embodiments are, of course, just as conceivable here as well.

BRIEF DESCRIPTION OF THE DRAWINGS

The following will make reference to the drawings in describing a preferred embodiment of the separable center position coupling designed for use in the inventive central buffer coupling. Shown are.

DESCRIPTION OF THE INVENTION

Figure 1:
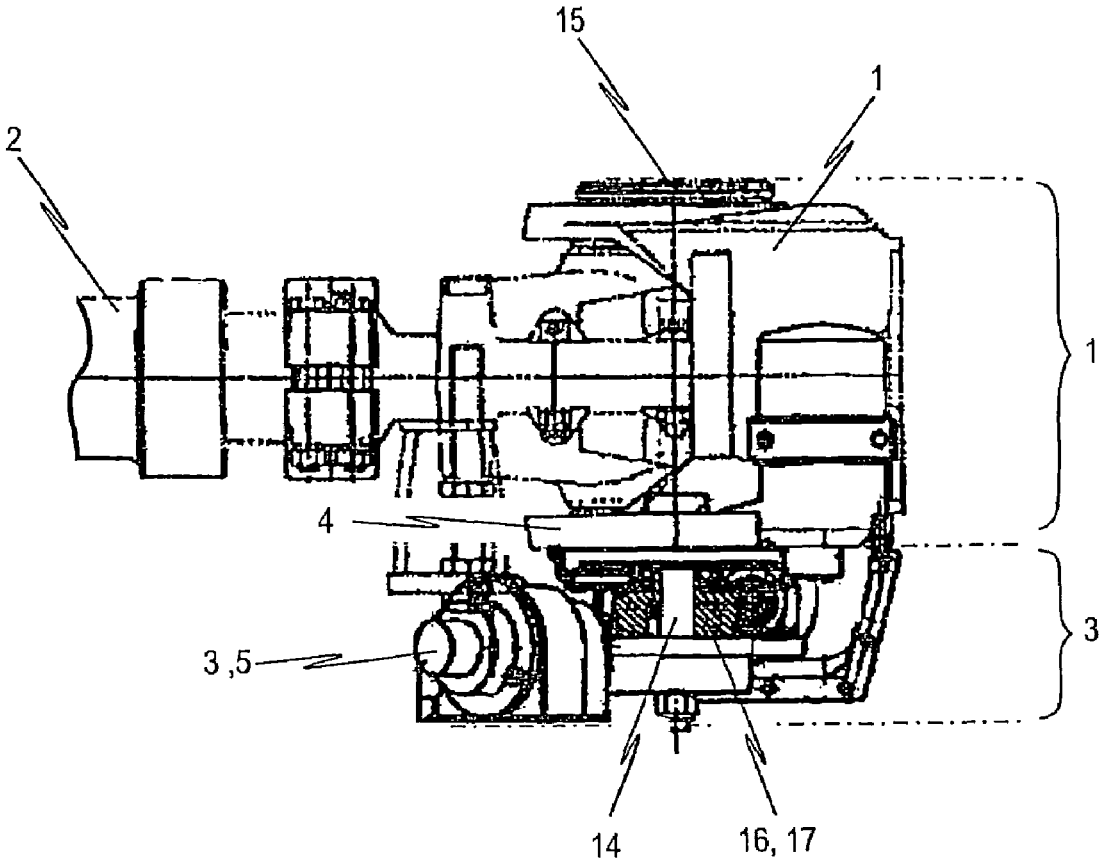
FIG. 1 is a partially cut-away side view of a device for resetting to center known from the prior art to illustrate the structure of the linkage, here including a center position device.

FIG. 1 shows a partially cut-away side view of a device for resetting to center known from the prior art for the purpose of illustrating the structure of linkage 1, here including a center position device 3. The device 3 for resetting to center is used with a central buffer coupling pivotably attached by means of a coupling shaft 2 to a (not explicitly depicted) vehicle body of a rail-mounted vehicle and has a center position guide 4 following the pivoting movement of coupling shaft 2 about a vertical pivot axis which can be positioned in any position of a given range of pivoting using actuating means 5 associated with center position device 3. As shown, coupling shaft 2 is pivotably connected by means of a vertically aligned bearing bolt 15 to an articulated housing of linkage 1 and by means of same to the (not shown) underframe of the rail-mounted vehicle. This connection is made with the corresponding connecting plates or crossbars (general connective members). In order to pivot the coupling shaft with the help of the actuating means of center position device 5, center position guide 4 shown in the central buffer coupling is configured as a cam plate, pivotably supported in linkage 1, the articulated housing respectively, by means of a vertically disposed swivel pin 14. Swivel pin 14 is connected to bearing bolt 15 and the center position guide 4 by a gear 16 arranged underneath same, which is in turn connected to and driven by the actuating means of the center position device 5 by means of gearing 17.

In this way, the actuating means of the center position device 5 of the coupling arrangement according to FIG. 1 and known in the art is tensionally locked to the bracket of linkage 1.

In the event of a crash; i.e., when extreme impact forces are transferred through coupling shaft 2 to linkage 1, the (not explicitly depicted) shearing elements, by means of which the bracket of linkage 1 is connected to the crossbar of the vehicle body, respond and lose their function as connective elements. In consequence thereof, linkage 1 together with the fixedly connected (entire) center position device 3 is pushed by the crossbar and thus removed from the force flux, whereby the (not explicitly depicted) secondary buffer systems can be used as overload protection devices to absorb the excess impact energy. As already clarified, the structure to such an overload protection requires that the crossbar be configured such that in the event of a crash, the entire linkage 1 together with the entire center position device 3; i.e., also including the actuating means of the center position device 5 arranged below linkage 1, can be pressed through by the crossbar.

With the objective of reducing the dimensions to the crossbar, and thus, the overall weight of the coupling arrangement as a whole, the invention now provides for a separable center position coupling 6.

Figure 2:
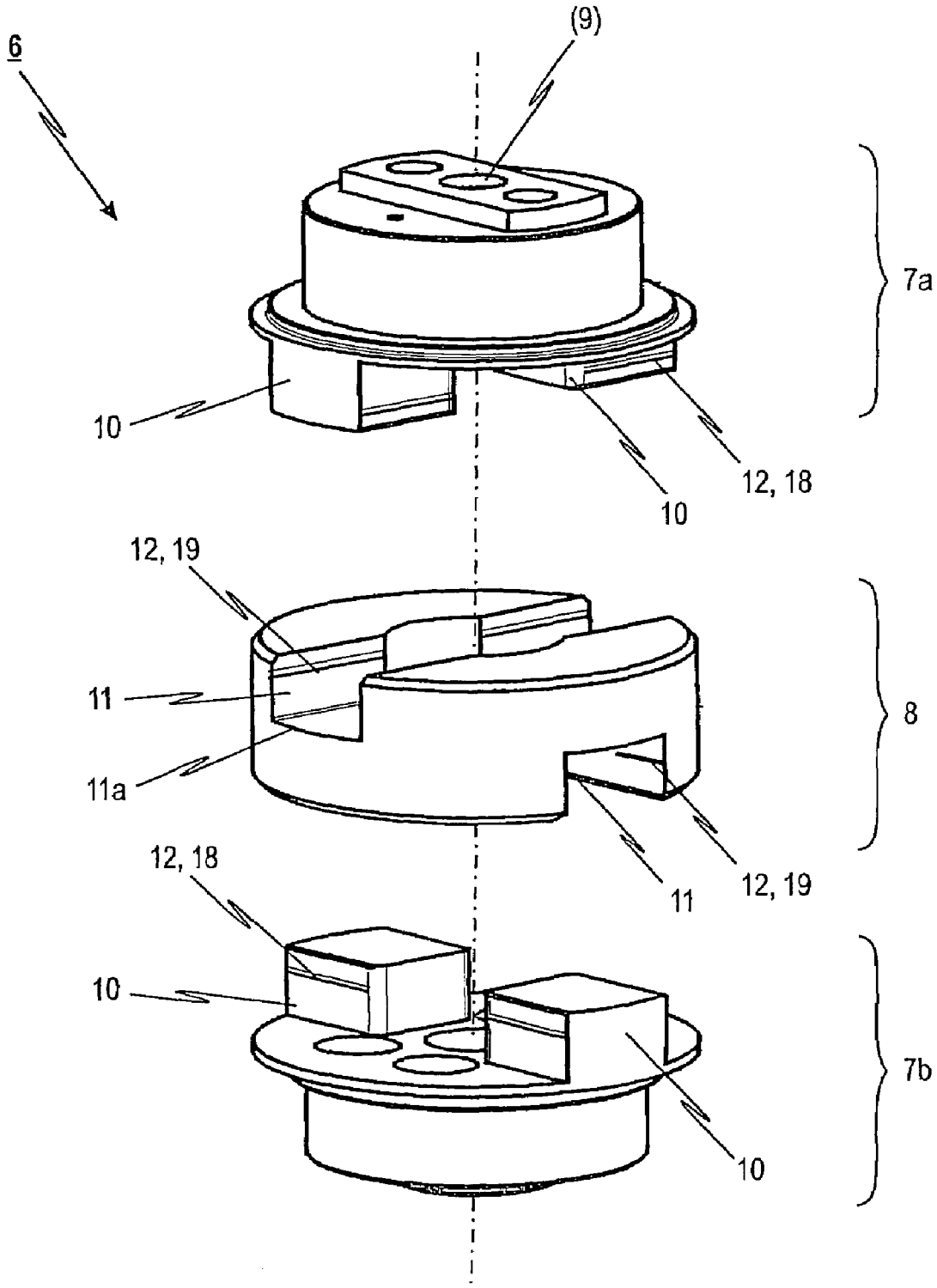
FIG. 2 is an exploded view of a preferred embodiment of a separable center position coupling designed for use in the inventive central buffer coupling.

FIG. 2 shows an exploded view of a preferred embodiment of a separable center position coupling 6 designed for use in the inventive central buffer coupling. The coupling, on the one hand, serves to reliably transfer the restoring moment of actuating means 5 to center position guide 4 of center position device 3 and thus, to coupling shaft 2 of the coupling arrangement during "normal" travel and, on the other hand, loses the function of a means to transfer torque upon a definable critical impact/tractive force being exceeded, thus, enabling that only linkage 1 alone can execute a backward motion; i.e., normally without actuating means 5 arranged below linkage 1 and provided for center position device 3.

For this purpose, the separable center position coupling 6 in accordance with FIG. 2 has an upper (outer) transfer element 7*a*, which is fixedly connected to center position guide 4 of center position device 3, and a lower (outer) transfer element 7*b*, which is normally arranged below linkage 1 and rigidly connected relative actuating means 5 of center position device 3. Center position coupling 6 according to FIG. 2 furthermore exhibits a middle transfer element 8 arranged between the two outer transfer elements 7*a*, 7*b*. Said middle transfer element 8 in this embodiment is configured as a cam plate with grooves 11 arranged at 90° to one another. In accordance hereto, outer transfer elements 7*a*, 7*b* exhibit a corresponding central crosspiece 10. In the assembled state, central crosspieces 10 of outer transfer elements 7*a*, 7*b* fit in the respective grooves 11 of cam plate 8 and thus, enable the transmission of the restoring moment of actuating means 5 to the center position guide 4 of the center position device 3.

Transfer elements 7*a*, 7*b*, 8 of the separable center position coupling 6 in accordance with FIG. 2 are each configured as plates arranged in axial alignment above one another in the assembled state. A pin 9 can axially extend through the longitudinal axis of these plates 7*a*, 7*b*, 8, to ensure the secure purchase of plates 7*a*, 7*b*, 8 to one another and to center position guide 4 as well as actuating means 5 of center position device 3. Said pin 9, which is not explicitly shown in FIG. 2, can be configured as a shearing element which shears off and loses its connective function upon a definable critical impact/tractive force being exceeding, in consequence of which transfer elements 7*a*, 7*b*, 8 can execute a movement relative one another and thus disengage their mutual engagements.

A guide means 12 is moreover provided in the form of a tongue-and-groove mechanism 12 in the separable center position coupling 6 in accordance with FIG. 2, whereby the tongue 18 of this tongue-and-groove means 12 is provided at the respective crosspieces 10 of the outer transfer members 7*a*, 7*b*, and whereby a corresponding groove 19 of the tongue-and-groove connection 12 is configured in the respective groove 11 of the middle transfer member 8. This guide means 12 serves to ensure that transfer members 7*a*, 7*b*, 8 can only execute a motion relative one another in the direction of the groove 11 configured in middle transfer element 8.

In one variant of the separable center position coupling 6, it is conceivable to configure one of the two central crosspieces 10 to be pivotable and the corresponding other central crosspiece 10 to be rigid. This thereby affords the possibility that the cam plate serving as the middle transfer member 8 respectively controlled by the outer transfer elements 7*a*, 7*b* can disengage after the critical impact/tractive force response.

Figure 3A:
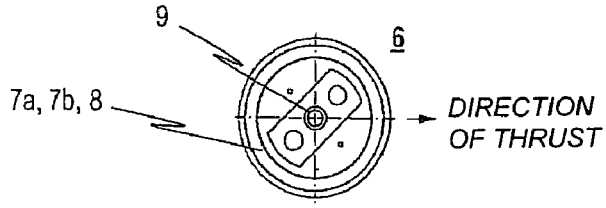
FIGS. 3A-F are the sequence of motion to the separation process for the separable center position coupling as shown in FIG. 2.
Figure 3B:
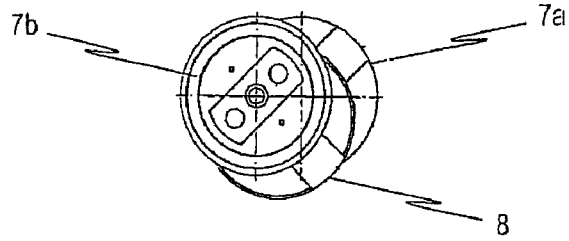
Figure 3C:
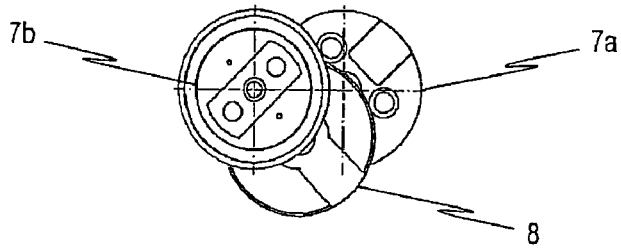
Figure 3D:
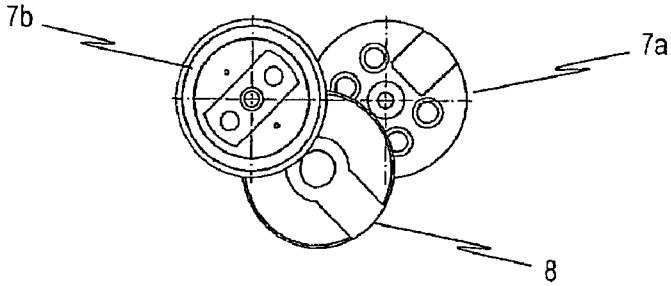
Figure 3E:
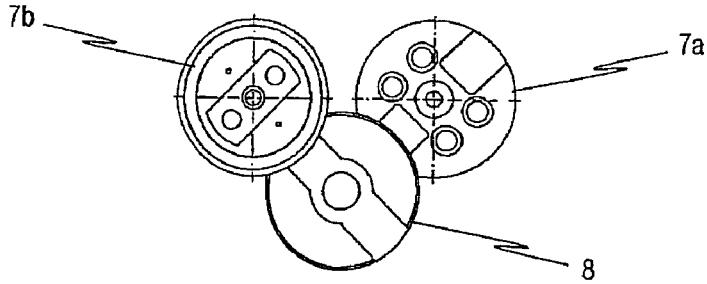

FIGS. 3A-F show the sequence of motion to the separation process for the separable center position coupling 6 in accordance with FIG. 2. FIG. 3A shows a top plan view of the separable center position coupling 6 in normal operating state. After exceeding of the critical, definable impact/tractive force and after the response of pin 9 extending through the vertical pivot axis of transfer members 7*a*, 7*b*, 8 and serving as shearing element, a relative motion occurs between transfer member 7*b* rigidly connected to actuating means 5 of center position device 3 and transfer member 7*a* rigidly connected to center position guide 4 of the central buffer coupling, in consequence of which middle transfer member 8 withdraws laterally and thus disengages the engagement between transfer elements 7*a*, 7*b*, 8.

Figure 3F:
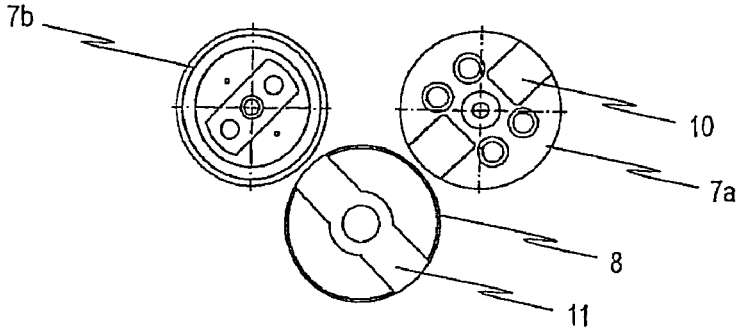

FIGS. 3B to 3E show different states prior to the complete disengaging of the engagement between the individual transfer elements 7*a*, 7*b*, 8. FIG. 3F shows the state in which the engagement of transfer elements 7*a*, 7*b*, 8 is completely disengaged and middle transfer member 8 is fully withdrawn, the connection between actuating means 5 and center position guide 4 provided in linkage 1 of the central buffer coupling therefore being disengaged.

Note is made at this point of the fact that the embodiment of the separable center position coupling 6 as described and depicted in FIGS. 2-3 only constitutes one example of an embodiment. It is of course also conceivable for a plate having the corresponding central crosspieces 10 offset 90° to one another to be used as the middle transfer element 8 in place of a cross-staff, wherein a corresponding groove 11 must then be configured in rigidly arranged transfer elements 7*a*, 7*b*.

It should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

What is claimed is:

1. A central buffer coupling for rail-mounted vehicles comprising:

a coupling shaft arranged to be vertically pivotable on a vehicle body of a rail vehicle by means of a linkage supporting a coupling head; and a device for horizontal resetting to center at its free end;

wherein the device for horizontal resetting to center includes:

a center position guide following a horizontal pivoting movement of the coupling shaft around a vertical pivot axis; and actuating means for positioning the center position guide together with the functionally-connected coupling shaft at predefined positions or into any position of a given range of pivoting;

wherein said center position guide is tensionally-locked to said actuating means by a center position coupling which transfers a restoring moment of said actuating means to said center position guide, whereby the tensionally-locked connection is disengaged upon exceeding of a definable critical impact/tractive force exerted longitudinal to the coupling shaft and transferred by same;

wherein said center position coupling has at least one outer transfer element arranged on said center position guide and at least one on said actuating means, and at least one further middle transfer element arranged therebetween; and wherein the outer transfer elements respectively engage with the middle transfer element in such a way so as to be able to transfer a restoring moment of said actuating means to said center position guide.

2. The central buffer coupling according to claim 1, wherein said center position coupling is configured such that the engagement between at least one outer transfer element and the middle transfer element disengages upon a definable critical impact/tractive force being exceeded and thus the tensionally-locked connection between center position guide and said actuating means is disconnected.

3. The central buffer coupling according to claim 1, wherein said center position coupling furthermore exhibits a pin extending lengthwise of the vertical pivot axis and through the respective transfer elements, fixedly connected to said center position guide at one end and to actuating means at its other end; and wherein said pin shears off upon the definable critical impact/tractive force being exceeded and thus enables disengaging the engagement of the at least one outer transfer element with the middle transfer element and the disconnecting of the tensionally-locked connection between said center position guide and said actuating means.

4. The central buffer coupling according to claim 1, wherein the outer transfer elements respectively arranged on said center position guide and on said actuating means each exhibit at least one central crosspiece;

wherein said middle transfer element exhibits at least two grooves in correspondence to said central crosspiece; and wherein said grooves provided in said middle transfer element are configured so as to each receive a corresponding central crosspiece of outer transfer elements so as to enable the transfer of the restoring moment of said actuating means to said center position guide.

5. The central buffer coupling according to claim 4, wherein the respective central cross-pieces of associated transfer elements are offset 90° from one another; and wherein the grooves of the respective transfer elements corresponding to the respective central crosspieces are likewise offset 90° accordingly.

6. The central buffer coupling according to claim 4, wherein at least one of the respective central crosspieces of the corresponding transfer elements is pivotably supported about a transverse axis of the respective central crosspiece and at least one of the respective central crosspieces is fixed.

7. The central buffer coupling according to claim 4, wherein said center position coupling further exhibits guide means configured so as to guide the grooves disposed in the corresponding transfer elements into the respectively corresponding cross-pieces of the associated transfer elements in the respective longitudinal direction of the grooves, and to substantially suppress a relative movement between the respective groove and the corresponding crosspiece in directions other than the longitudinal direction of the respective groove.

8. The central buffer coupling according to claim 7, wherein said guide means exhibits a tongue-and-groove connection provided in said groove and on said central crosspieces of said transfer elements.

9. The central buffer coupling according to claim 1, wherein said middle transfer elements exhibits at least two central crosspieces;

wherein the outer transfer elements arranged respectively on said center position guide and said actuating means each exhibit at least one groove in correspondence to the at least one central crosspiece; and wherein the at least one said groove provided in the respective outer transfer elements are respectively configured so as to each receive at least one corresponding central crosspiece of said middle transfer element so as to enable the transfer of the restoring moment of said actuating means to said center position guide.

10. The center buffer coupling according to claim 9, wherein said groove and the associated central crosspiece respectively exhibit an interlocking dove-tailed profile wherein a broad side of the dove-tailed profile is provided at a base area of said groove.

* * * * *